US006983706B2

(12) United States Patent
Marcangelo

(10) Patent No.: US 6,983,706 B2
(45) Date of Patent: Jan. 10, 2006

(54) METHOD OF MANUFACTURING COVER FOR A BEDDING PRODUCT

(75) Inventor: Steven Marcangelo, North Chelmsford, MA (US)

(73) Assignee: L&P Property Management Company, South Gate, CA (US)

( * ) Notice: Subject to any disclaimer, the term of this patent is extended or adjusted under 35 U.S.C. 154(b) by 119 days.

(21) Appl. No.: 11/005,610

(22) Filed: Dec. 6, 2004

(65) Prior Publication Data

US 2005/0204979 A1 Sep. 22, 2005

Related U.S. Application Data

(62) Division of application No. 10/804,923, filed on Mar. 19, 2004.

(51) Int. Cl.
*D05B 11/00* (2006.01)

(52) U.S. Cl. ..... 112/475.08; 112/2.1

(58) Field of Classification Search ..... 112/475.08, 112/2.1, 139, 418, 419, 429, 436, 46, 47, 112/52, 136, 144, 153, 470.27, 132, 147; 5/716, 717

See application file for complete search history.

(56) References Cited

U.S. PATENT DOCUMENTS

| | | | | | |
|---|---|---|---|---|---|
| 2,773,266 | A | * | 12/1956 | Blumenkrantz | 112/417 |
| 3,028,641 | A | * | 4/1962 | Hendrie | 112/441 |
| 3,031,985 | A | * | 5/1962 | Kalning et al. | 112/2.1 |
| 3,857,126 | A | * | 12/1974 | Woodruff | 5/698 |
| 3,867,890 | A | * | 2/1975 | Hamilton et al. | 112/139 |
| 3,940,812 | A | * | 3/1976 | Zapf | 112/418 |
| 4,866,799 | A | * | 9/1989 | Glackin | 5/698 |
| 5,983,814 | A | * | 11/1999 | Block | 112/2.1 |
| 6,397,768 | B1 | * | 6/2002 | Dasher et al. | 112/2.1 |

* cited by examiner

*Primary Examiner*—Ismael Izaguirre
(74) *Attorney, Agent, or Firm*—Wood, Herron & Evans, LLP

(57) ABSTRACT

A bedding foundation is manufactured with a cover having a welt cord extending upwardly to create a seal when a mattress is placed on the foundation. The cover is made using a two stage process. During the first stage a sewing machine is used to join a welt cord to a web of border material. In the second stage a second sewing machine sews a piece of non-skid decking to the border assembly. Fullness may be incorporated into the border material to enable the cover to fit around the corners of the bedding foundation with the welt cord being spaced inwardly from the perimeter of the foundation.

19 Claims, 10 Drawing Sheets

METHOD OF MANUFACTURING COVER FOR A BEDDING PRODUCT

CROSS-REFERENCE TO RELATED APPLICATIONS

This application is a divisional of U.S. patent application Ser. No. 10/804,923 filed Mar. 19, 2004 entitled "Method For Manufacturing Cover For a Bedding Product and Resulting Product" which is fully incorporated by reference herein.

FIELD OF THE INVENTION

This invention relates generally to bedding products and more particularly, to a method and apparatus for manufacturing a cover for a bedding foundation.

BACKGROUND OF THE INVENTION

The sewing of various components of a bedding product such as a mattress or bedding foundation together to form a finished product presents several sewing challenges. One such challenge is the sewing of the components at their respective corners. Attaching an upper decking to a border or side panel of a bedding foundation presents numerous challenges. With one known process, an edge of the upper decking material is sewn to an edge of the side panel or border material along the outer edge of the bedding foundation. The joint between the corner of the upper decking can be precut so that there is no or minimal excess material at the corner. If the corners in the upper decking material are not precut, the machine operator must gather the material to accommodate the extra material at the corners. Unless the operator is particularly skilled, sometimes the result is a rather uneven look, since the bedding foundation components are unwieldy and difficult to maneuver around the corners. Further, since the sewn joint is at the edge of the bedding foundation, the upper decking material is often visible even after a mattress is set on top of the bedding foundation.

To provide a better finished appearance, it is also known to attach the bedding foundation border material to the upper decking material at a location inside the outer edge of the bedding foundation, for example, 3–4 inches inside the bedding foundation edge. This type of bedding foundation is known in the industry as a continental bedding foundation. However, to provide a desirable finished appearance, it is necessary to miter the bedding foundation border material as it is formed around the corners of the bedding foundation. Mitering of the bedding foundation border material is accomplished by techniques similar to those described above. While improving the appearance of the finished bedding foundation, the additional labor required substantially increases the manufacturing cost of the bedding foundation.

Therefore, there is a need to further improve the process of attaching the upper decking material to the border material of a bedding foundation.

Materials used to make bedding products such as mattresses and bedding foundations have been known to burn quickly when ignited. Due in part to a number of deaths each year caused by smokers falling in sleep in bed with a lighted cigarette, there is pressure on manufacturers of bedding products to manufacture a product which is resistant to fire. States have recently enacted new standards regarding open-flame mattress flammability. Bedding manufacturers are attempting to comply with the new state laws by constructing bedding sets which burn more slowly, enabling occupants plenty of time to escape the building in which the sleeping set is located in the event the bedding set ignites.

In both seating and bedding products, a welt cord may be incorporated into the product around the perimeter of the product. A lighted cigarette when dropped may fall or roll into a position adjacent the welt cord. Consequently, welt cords such as disclosed in U.S. Pat. No. 4,598,622 have been manufactured to inhibit combustion.

Due to the combustible nature of the materials used to manufacture bedding foundations and mattresses, such products may be easily ignitable and once ignited may combust quickly. Air entering between the mattress and bedding foundation or box spring can further fuel the fire and/or speed the combustion of the interior of either the mattress or foundation. A great amount of heat may be generated in a short time frame.

Therefore, there is a need for a bedding foundation which inhibits air from entering between the bedding foundation and a mattress resting on top of the foundation.

SUMMARY OF THE INVENTION

One aspect of the present invention provides a method of manufacturing a cover for a bedding product. The bedding product is preferably a bedding foundation but may be a mattress or any other product. The method involves forming a welt cord by wrapping material around a filler cord, securing the welt cord to a continuous web of border or side panel material to form a welted border or border assembly. The welted border is then measured to a predetermined length, cut and opposite ends of the border material secured together to form a loop of welted border material. The last step in forming the cover is to secure non-skid decking to the loop of border material, the welt cord being sandwiched between the border material and the decking.

The welt cord is made from a continuous web of welt material which is folded around a filler cord. One type of welt material which has been used is flame retardant tape three inches wide. However, any other size or material may be used in accordance with the present invention. The filler cord is preferably unwound from a roll, surrounded with welt material also unwound from a roll at a folder. One type of cord which has been used is flame retardant, 0.5 inches in diameter, has kevlar webbing and is supplied by the Atlantic Thread Company. However, cording of any other size or material may be used in accordance with the present invention. Although one type of folder is illustrated, any type of folder may be used in accordance with the present invention. The folder is attached to the front of a sewing machine in any conventional manner.

According to another aspect of the present invention, the method of manufacturing the cover involves building fullness into the border material to accommodate the corners of the bedding product. This is accomplished by gathering the border material at selection locations during the sewing of the welt cord to the web of border material.

According to another aspect of the present invention, the sewing apparatus of the present invention is a two part apparatus utilizing two different sewing machines. The first sewing machine of the sewing apparatus is used to create a border assembly during the first stage of the process. The second sewing machine is used to sew an upper decking of the cover to a loop of border assembly during a second stage of the process.

The first sewing machine of the present invention sews a continuous welt cord to a continuous web of border or side panel material. This part of the sewing apparatus utilizes a cutter to cut a predetermined length of border assembly after the welt cord is sewn onto the web of border material. The sewing machine used in this first stage has a pair of rotatable pullers, the speed of which is controlled by a controller. The capability of programming the first sewing machine to slow the pullers of the sewing machine enables the sewing machine to gather the side or border panel at select locations prior to sewing. This fullness built into the border material of the border assembly permits a bedding manufacturer to create a cover having an upwardly directed welt on top of the bedding foundation after the cover is place around the foundation. The welt cord of the cover is located on the top surface of the bedding foundation and spaced inwardly a fixed distance from the perimeter of the foundation. The welt cord enhances the product's ability to withstand combustion.

According to another aspect of the present invention, the invention provides a unique presser foot secured to a presser foot shaft of the first sewing machine. The unique configuration of the presser foot enables the web of border material to be gathered at select locations prior to sewing the welt cord to the web of border material. The pressure foot has a upper plate with a hole through it which enables the needle of the first sewing machine to pass through the presser foot. The presser foot has a lower plate smaller is size than the upper plate, the lower plate being in front of the needle so that it does not interfere with the reciprocation of the needle.

During operation of the first sewing machine, the welt cord is fed between the upper and lower plates of the presser foot. The continuous web of border material is fed underneath the lower plate of the presser foot and pulled rearwardly by a rotatable feed dog which operates at a specified rate so as to pull the web of border material a fixed distance per stitch of the sewing machine. As the feed dog pulls the border material rearwardly past the reciprocating needle, the needle sews the web of border material to the welt cord located above the web of border material. Once the welt cord and web of border material are sewn together, the puller located behind the presser foot pulls the combined welt cord and web of border material further rearwardly.

In normal operation, the puller and the feed dog operate at the same stitch rate or rotational speed so that the web of border material and the welt cord move at the same speed. Operation of the sewing machine in this fashion providing a smooth seam or joinder of the welt cord to the web of border material.

In order to impart fullness at select locations of the border material (where the corners of the bedding foundation are when the cover is completed and installed), the speed rate of the puller is slowed while the speed rate of the feed dog is maintained. Thus, due to the configuration of the presser foot, the linear speed at which the welt cord is moving slows while the linear speed at which the web of border material moves continues at a faster rate. Thus the border material is gathered or bunched at these locations for a specified distance. Once the desired length of web of border material has been sewed to the welt cord in this bunched manner, the controller increases the speed of the puller to equal that of the feed dog. Then for a specified distance, the welt cord is sewn to the web of border material without bunching of the web of border material. The process is then repeated until four bunches are formed in the web of border material for the four corners of the foundation cover.

These and other objects and advantages of the present invention will become more readily apparent during the following detailed description taken in conjunction with the drawings herein.

DETAILED DESCRIPTION OF THE INVENTION

Figure 1:
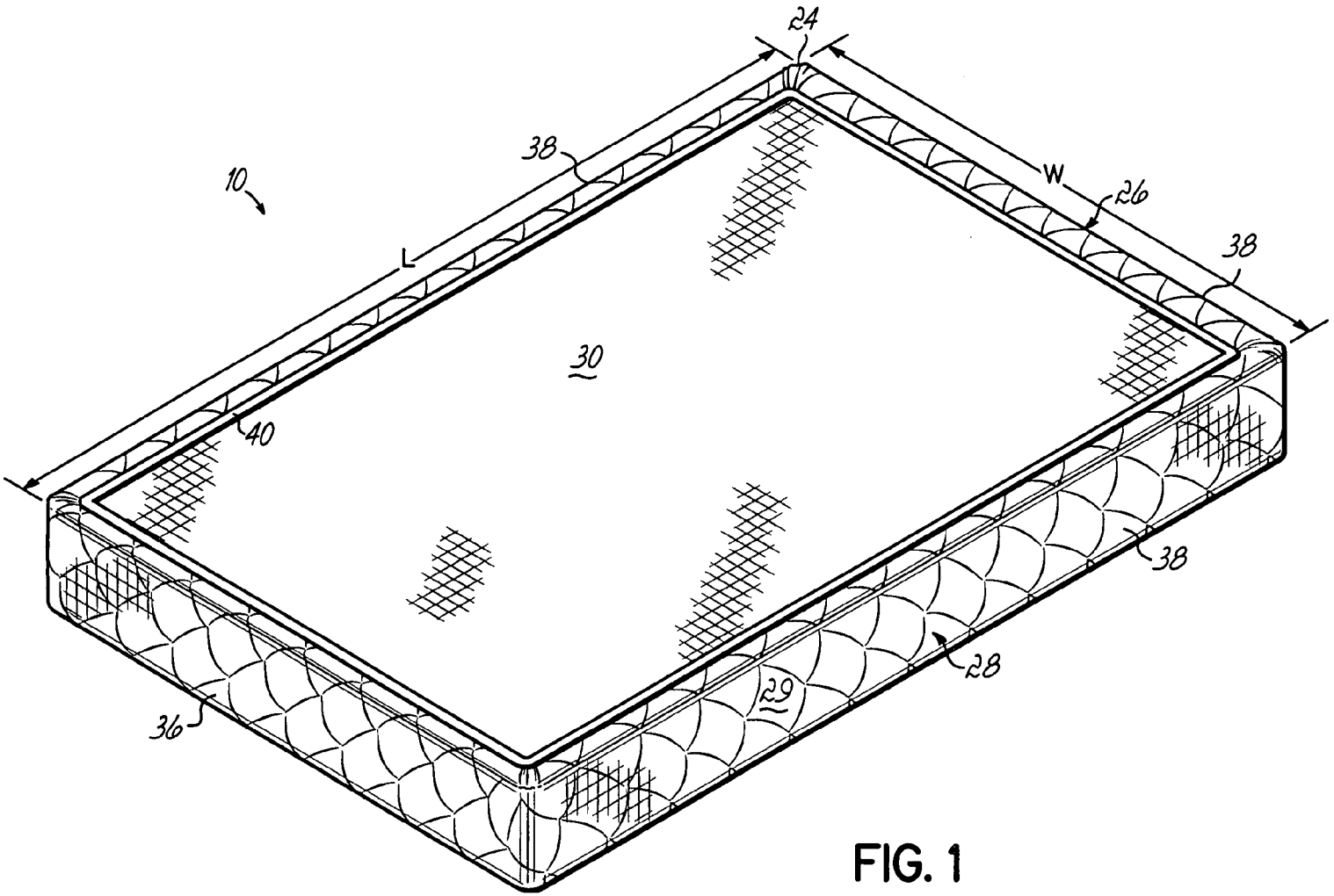
FIG. 1 is a perspective view of a bedding foundation having a cover made in accordance with the principles of the present invention.

Referring to the drawings and particularly to FIG. 1, there is illustrated a bedding product 10 in the form of a bedding foundation or box spring. Although the bedding product 10 illustrated in FIG. 1 is a bedding foundation, the method of the present invention may be used to cover any bedding product including a mattress, such as the one shown in FIG. 2.

Figure 2:
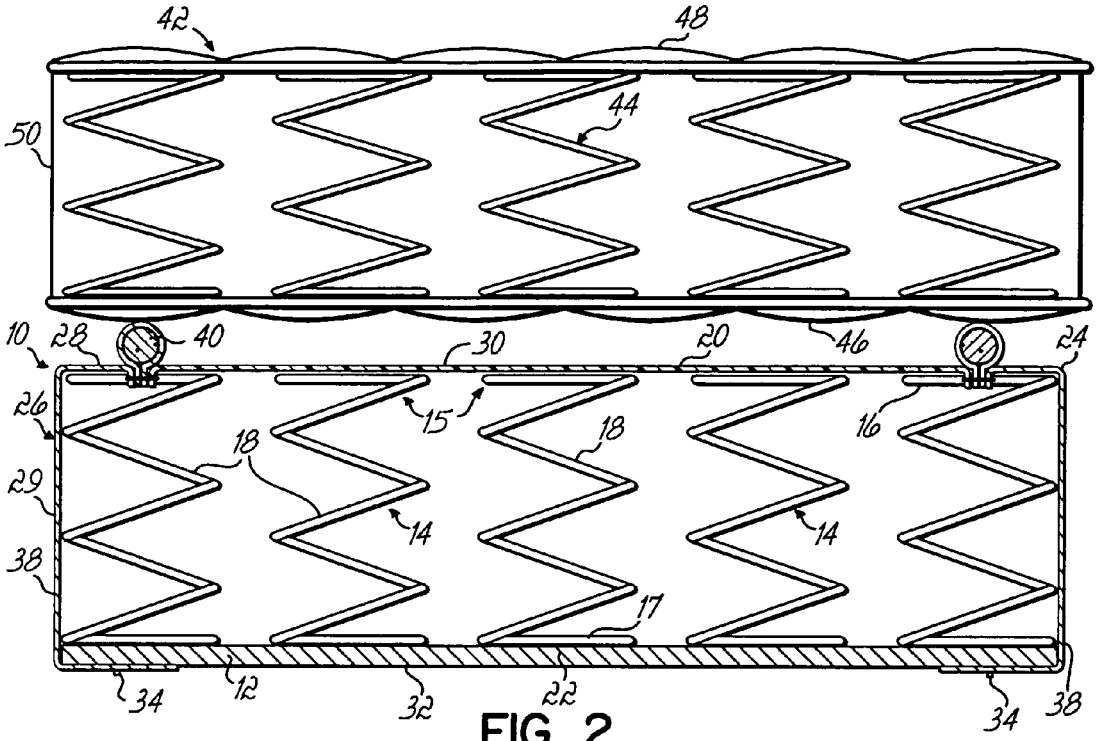
FIG. 2 is cross sectional view of the bedding foundation of FIG. 1 illustrating a mattress on top of the foundation.

Referring to FIG. 2, the box spring 10 of the present invention comprises a base 12 to which are secured a plurality of coil springs 14 joined into a spring assembly 15. The springs 14 extend upwardly from the base 12 in a conventional manner. Each coil spring 14 has an upper end turn 16, a lower end turn 17 and a plurality of central convolutions 18 therebetween. The upper end turns 16 are preferably coplanar defining an upper surface 20 of the coil spring assembly 15. Similarly, the lower end turns 17 are preferably coplanar defining an lower surface 22 of the spring assembly 15. Although coil springs are illustrated, any type of springs may be used in accordance with the present invention. The base 12 is preferably made of wood but may be made of any material. The springs 14 are aligned in tranversely extending rows and longitudinally extending columns, as is conventional. The upper end turns 16 of the outermost columns and rows of springs make up an upper peripheral edge 24 of the bedding foundation.

Referring to FIG. 2, the base 12 and springs 14 of the bedding foundation 10 are covered with a cover 26. The cover 26 is made by securing a specified length of border or side panel material 28 to a generally rectangular piece of non-skid decking 30. The side panel or border material 28 has an exterior surface 29 upon which may be quilted a desired pattern and/or upon which may be printed any desired message. As shown in FIG. 2, the border material 28 of the cover 26 is secured to the lower surface 32 of the base 12 with staples 34 or any other suitable means, such as adhesive or weldments. As shown in FIG. 1, the piece of non-skid decking material 30 covers the upper surface of the bedding foundation 10. Although not illustrated, if desired, multiple layers of padding and/or other cushioning materials may be placed above the upper end turns of the coil springs 14 of the foundation 10 inside the cover 26.

Referring to FIG. 1, once covered the bedding foundation 10 has a pair of end surfaces 36 which define the length or longitudinal dimension L of the product. Similarly, the covered bedding foundation 10 has a pair of side surfaces 38 which define the width or transverse dimension W of the product.

As best illustrated in FIGS. 1 and 2, the bedding foundation 10 has a welt cord 40 secured to the cover 26 and spaced inwardly a fixed distance from an upper perimeter 24 of the bedding foundation 10. The welt cord 40 extends upwardly from the upper surface 20 of the bedding foundation 10 and from the generally planar decking 30. The welt cord 40 is secured to both the border material 28 and the non-skid decking material 30 in a manner described below.

As show in FIG. 2, a mattress 42 comprising a plurality of interconnected coil springs 44 is placed on top of the bedding foundation 10 such that the welt cord 40 contacts the lower surface 46 of the mattress. The mattress 42 has an upper surface 48 and side surfaces 50, as is conventional. Although a mattress with coil springs is illustrated, any other type of mattress may be used in accordance with the present invention. The welt cord 40 forms an air tight seal around the perimeter of the decking 30 of the foundation when the mattress 42 is placed thereon. This gasket or seal formed by the interaction of the welt cord 40 with the lower surface 46 of the mattress 42 slows the combustion of the materials of the bedding foundation and mattress in the event of fire.

Figure 3A:
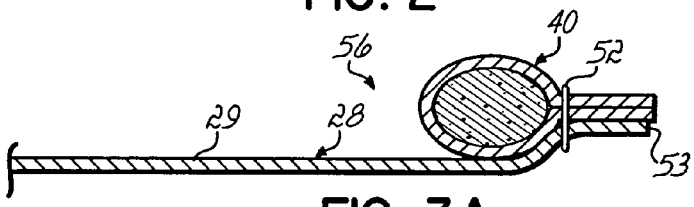
FIG. 3A is a cross sectional view of a web of border material attached to a welt cord to create a border assembly.
Figure 3B:
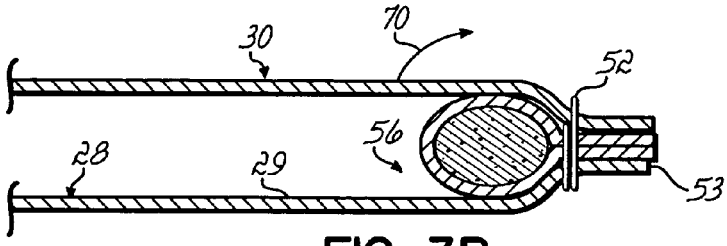
FIG. 3B is a cross sectional view of a piece of non-skid decking attached to the border assembly of FIG. 3A.
Figure 3C:
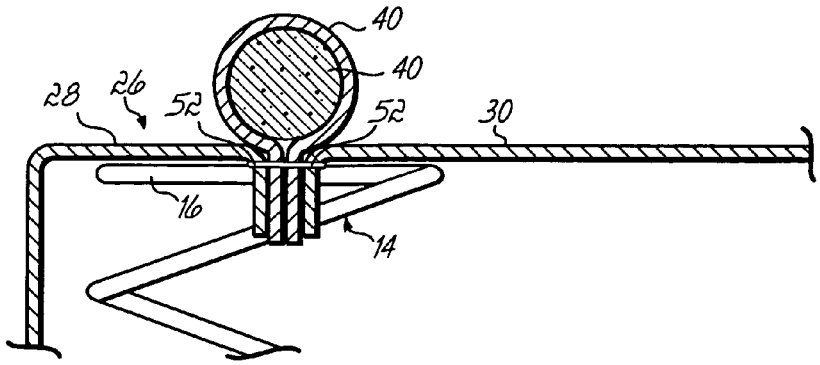
FIG. 3C is a cross sectional view illustrating a portion of the cover of FIG. 3B placed over a bedding foundation.
Figure 4:
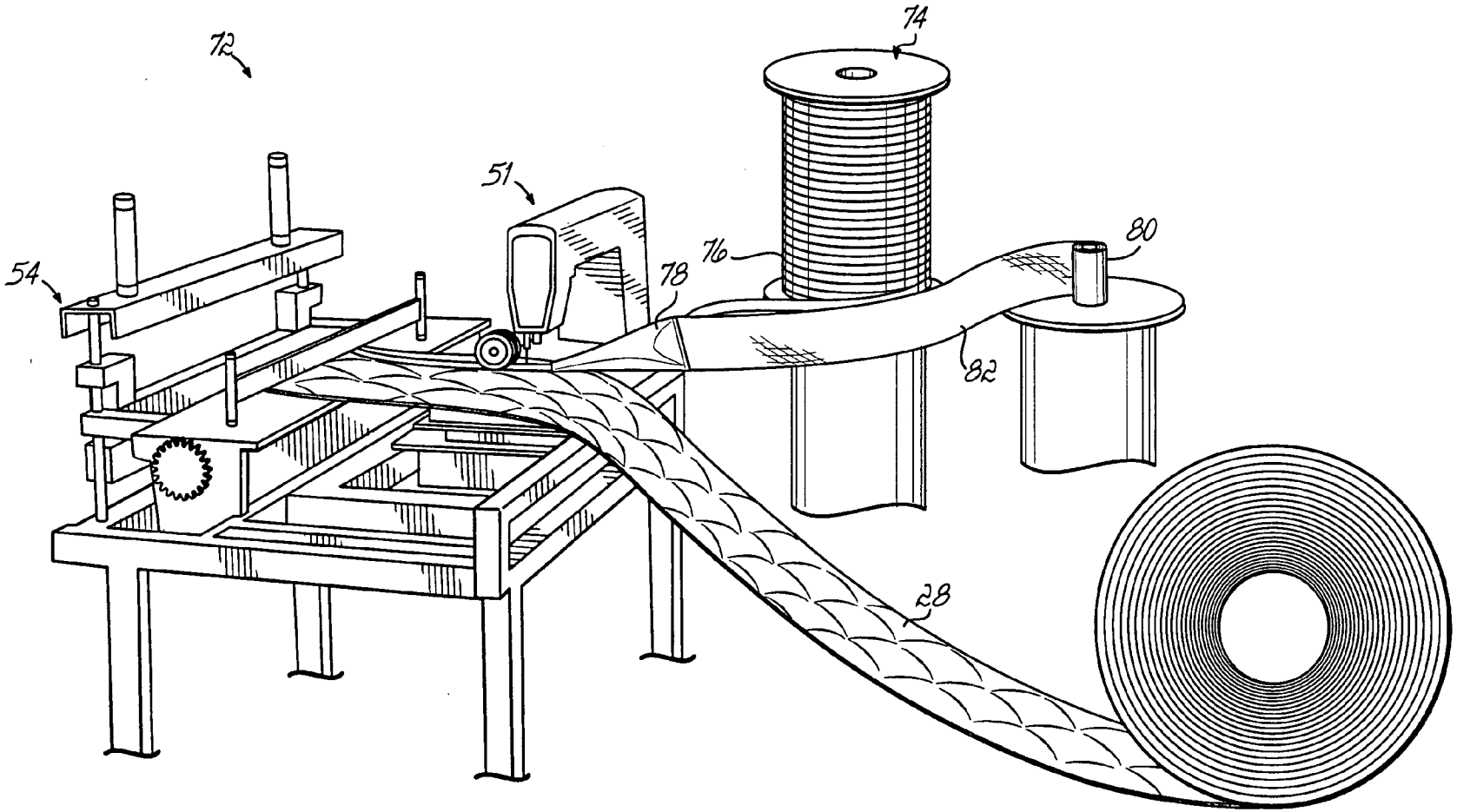
FIG. 4 is perspective view of a portion of the sewing system of the present invention.

Referring to FIGS. 3A through 3C, the method of manufacturing the cover 26 for the foundation 10 is illustrated. First, welt cord 40 is formed in a manner described below. The welt cord 40 is placed above the continuous web of side panel or border material 28 as illustrated in FIG. 3A. The exterior surface 29 of the web of border material 28 is facing upwardly in FIG. 3A. The welt cord 40 is then secured to the web of side panel or border material 28. Preferably this securement occurs on a first sewing machine 51 as shown in FIG. 4. The stitches are illustrated in FIG. 3A by the numeral 52.

According to one preferred embodiment of the present invention, the border material is 14 inches wide and the stitches 52 are located approximately 0.75 inches from the side edge 53 of the web of border material 28. See FIG. 3A.

Figure 11:
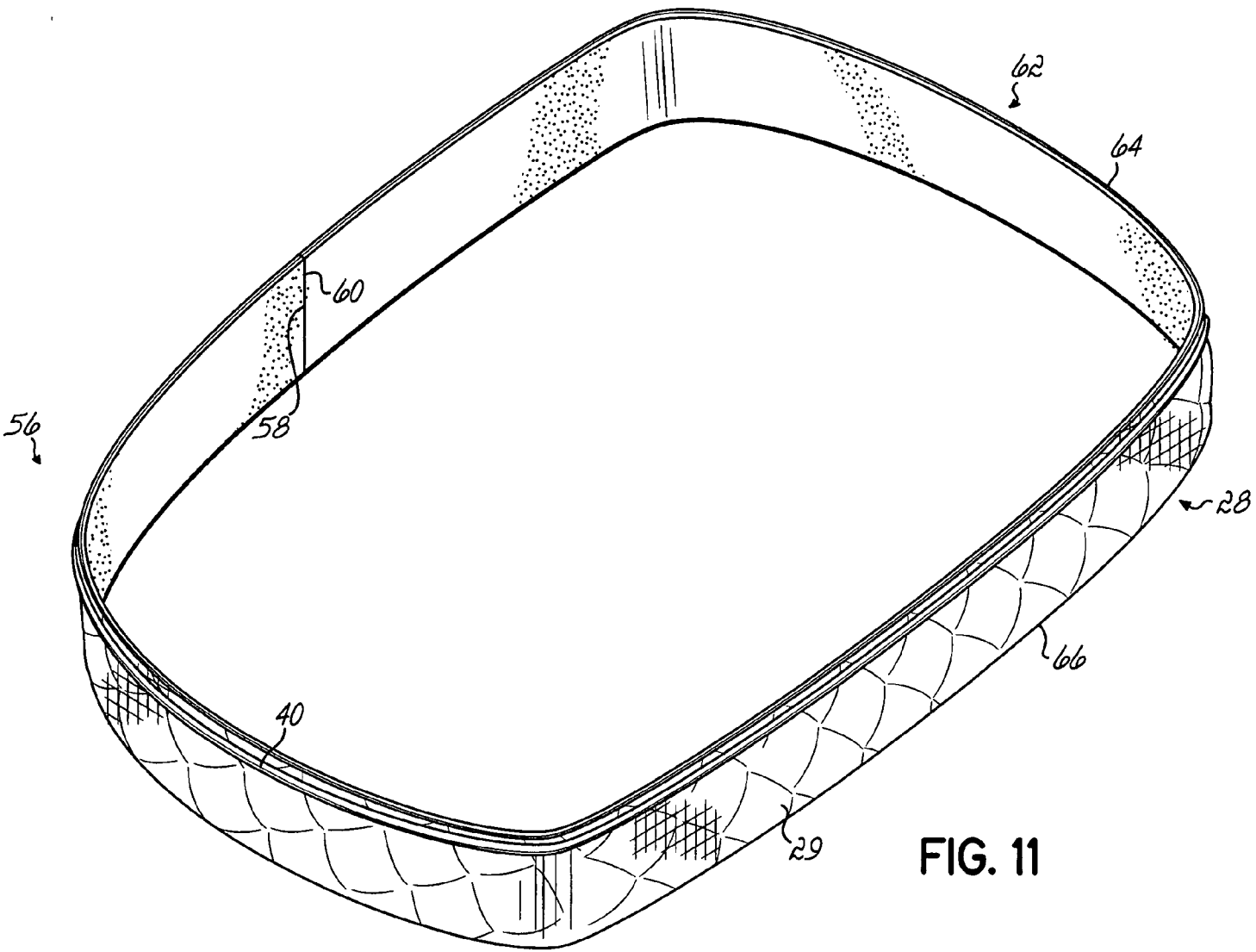
FIG. 11 is a perspective view of a closed loop of border assembly.

Once the desired length of welt cord 40 has been secured to the desired length of border material 28, the web of border material 28 and welt cord 40 are cut with a cutter 54 like the one illustrated in FIG. 4. For purposes of this document, the combined welt cord 40 and web of border material 28 are referred to as a border assembly 56 or welted border. As shown in FIG. 11 opposite ends 58, 60 of the cut border assembly 56 are sewn or otherwise joined together to form a border loop 62 shown in FIG. 11, the welt cord 40 extending outwardly from the exterior surface 29 of the border material 28 proximate the upper edge 64 of the border loop 62. The lower edge 66 of the border material 28 is located underneath the bedding foundation 10 once the cover 26 is secured to the base 12 of the bedding foundation 10. See FIG. 1.

Figure 10:
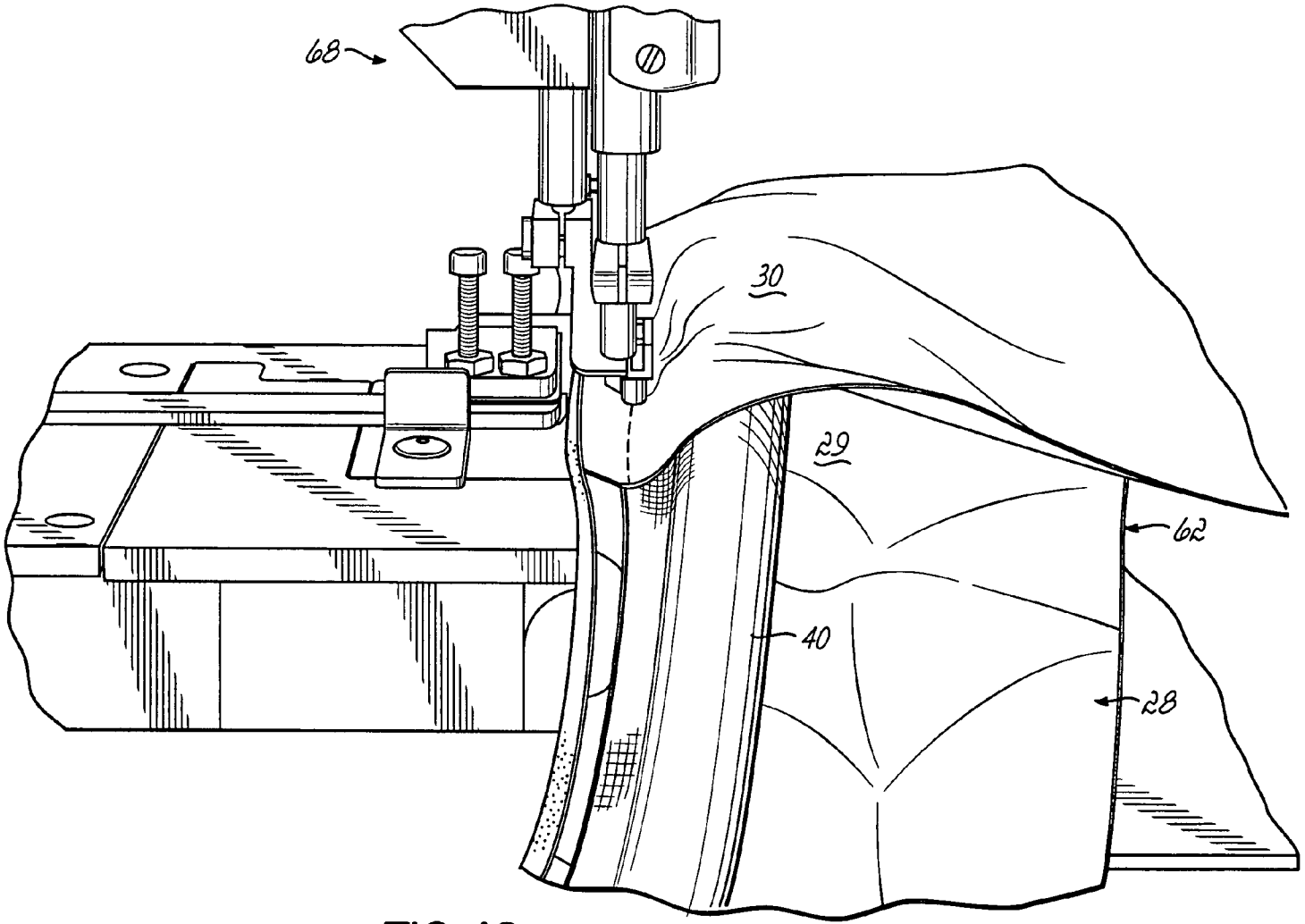
FIG. 10 is a perspective view of a second part of the sewing system of the present invention.

Referring to FIGS. 3B and 10, the next step in the process is to secure the generally rectangular piece of non-skid decking material 30 to the border loop 62, the welt cord 40 being sandwiched between the border material 28 and the non-skid decking 30. Preferably this sewing step occurs on a second sewing machine 68 partially shown in FIG. 10. This second sewing machine 68 is not shown in FIG. 4 and forms a second part of the sewing system of the present invention. However, this step in the process may occur on any sewing machine including the first sewing machine.

Referring to FIG. 3B, after the perimeter of the piece of non-skid decking 30 is sewn to the border loop 62, the piece of non-skid decking 30 is then pulled back in the direction of arrow 70 in order to expose the welt cord 40, as shown in FIG. 3C. The completed cover 26 is then placed around the spring assembly 15 and base 12 of the bedding foundation 10 in the manner shown in FIG. 3C such that the welt cord 40 is spaced inwardly a fixed distance from the perimeter 24 of the upper surface 20 of the bedding product and extends upwardly.

FIGS. 4–10 illustrate a two part sewing system 72 used to construct the cover 26 shown in FIG. 1. The first part of the sewing system 72 is illustrated generally in FIG. 4 and the second part of the sewing system 72 is illustrated generally in FIG. 10. The second part of the sewing system 72 comprises the second sewing machine 68 which may be any conventional sewing machine.

Figure 5:
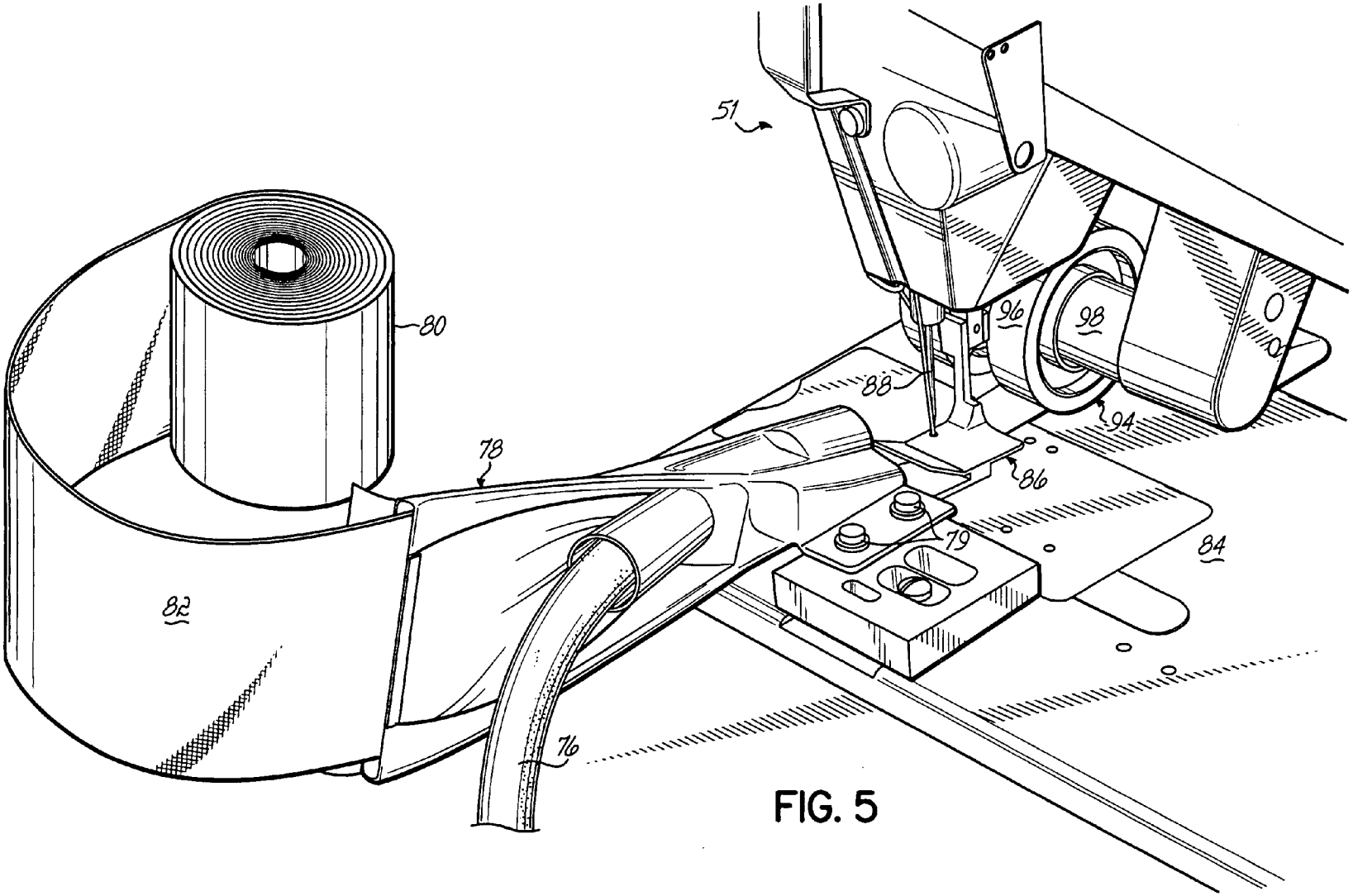
FIG. 5 is perspective view of a portion of the sewing system of FIG. 4.
Figure 8:
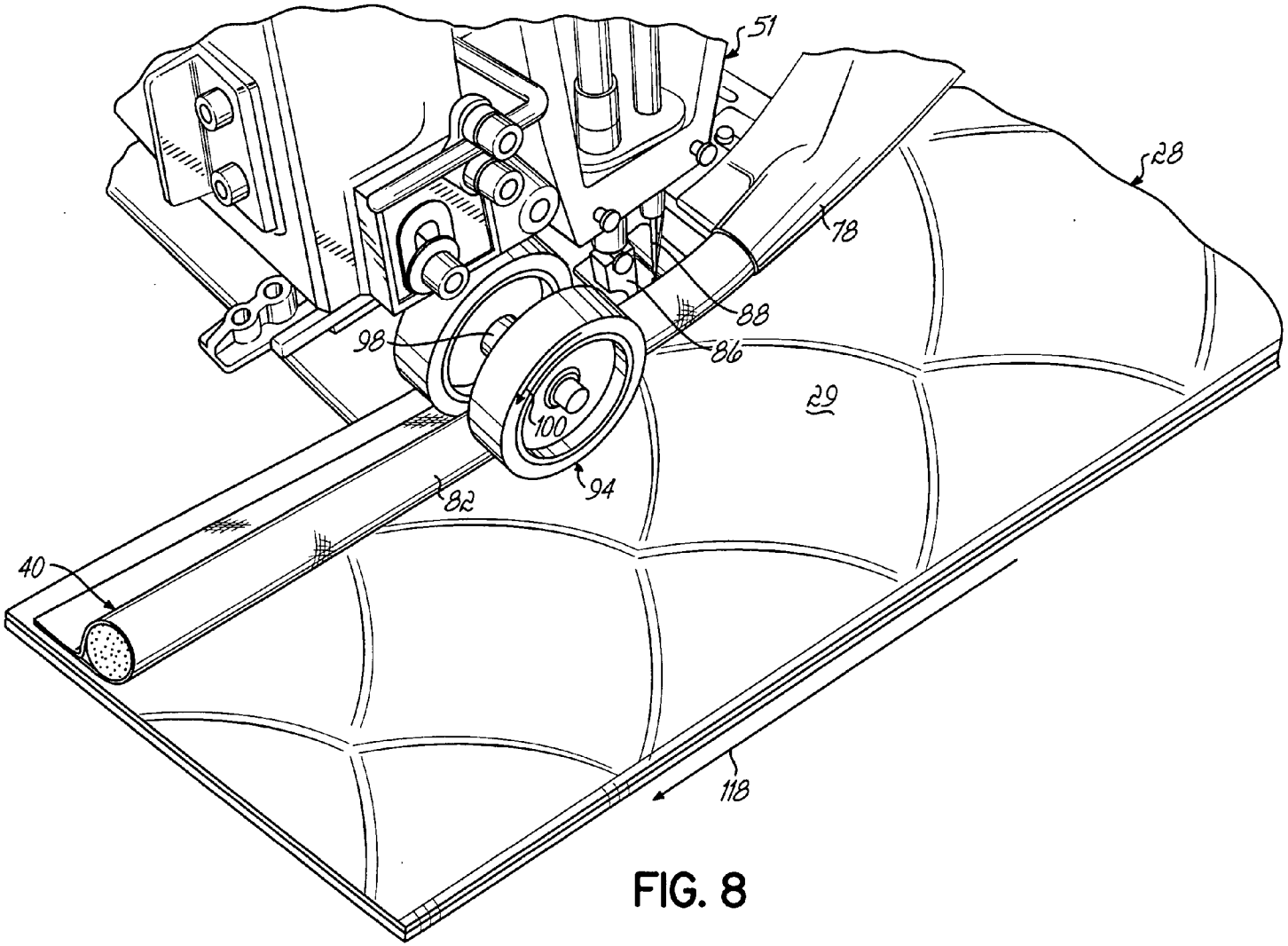
FIG. 8 is a perspective view of a portion of the sewing system of FIG. 4 illustrating the sewing process.

The first part of the sewing system 72 includes a roll 74 of filler cord 76 which is fed into a folder 78. As shown in FIG. 5, one configuration of folder 78 is secured to the first sewing machine 51 with bolts 79. However, any other type of folder may be secured to the first sewing machine 51 in any desired manner to form the welt cord 40. The first part of the sewing system 72 further comprises a roll 80 of welt material 82 which is fed into the folder 78 in the manner shown in FIG. 5. The folder 78 folds the welt material 82 around the filler cord 76 before the welt material 82 is sewn to the web of border material 28 as shown in FIG. 8.

Figure 6:
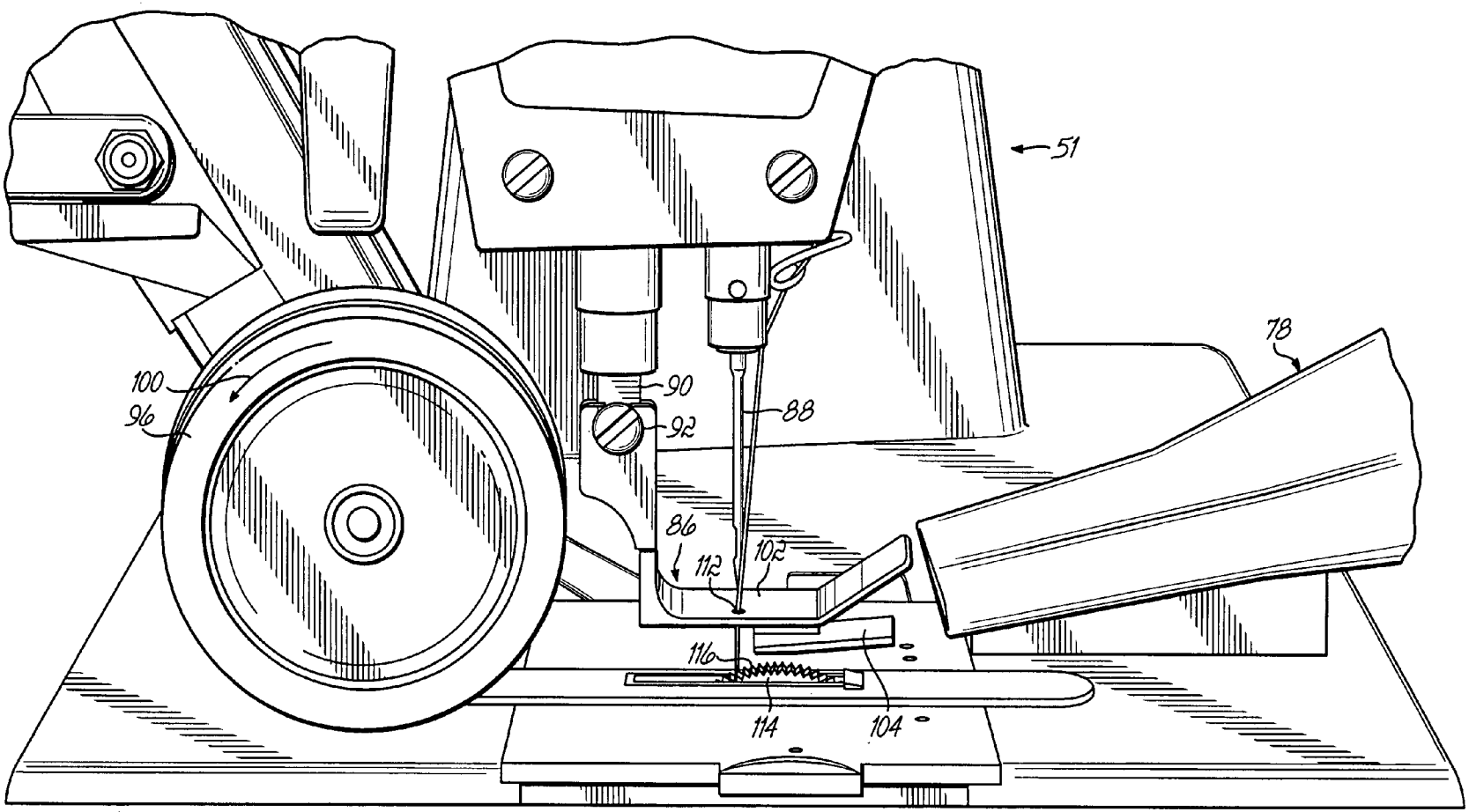
FIG. 6 is a perspective view of a portion of the sewing system of FIG. 4.

Referring to FIG. 5, the first sewing machine 51 is mounted on a base plate 84 in a known manner. The first sewing machine 51 includes a presser foot 86 shown in detail in FIGS. 7A and 7B and a needle 88 that is reciprocated and carries a needle thread and a bobbin thread in a known manner. The needle thread is preferably Kevlar® thread for fire resistance but may be any type of thread. The first sewing machine 51 is a commercial sewing machine that performs lock stitching. Lock stitching is a known technique of interlacing a needle thread and bobbin thread, which will not be further described here. The presser foot 86 is mounted on a presser foot shaft 90 of the sewing machine by means of a screw 92 as shown in FIG. 6. The presser foot shaft 90 is located downstream or behind the needle 88 and reciprocates like the needle. See FIGS. 5 and 6.

As shown in FIGS. 5 and 6, a puller 94 comprises two spaced rotatable wheels 96 mounted on a common shaft 98 and is located downstream of the presser foot shaft 90. The function of the puller 94 is to pull the web of border assembly 56 after the welt cord 40 is secured to the web of border material 28 in a downstream direction towards the cutter 54, as shown in FIG. 4. The wheels 96 of the puller 94 rotate in a direction indicated by arrow 100 shown in FIGS. 6 and 8.

The operation of the puller 94 is controlled by a programmable control for example, a commercially available programmable logic controller. The control includes a user input/output ("I/O") interface that provides various user operable input devices, for example, pushbuttons, switches, etc., as well as various sensory perceptible output devices, for example, lights, a visual display such as an LCD screen, etc. The user I/O permits the user to command the operation of individual servomotors and cylinders connected to outputs of the control.

Figure 7A:
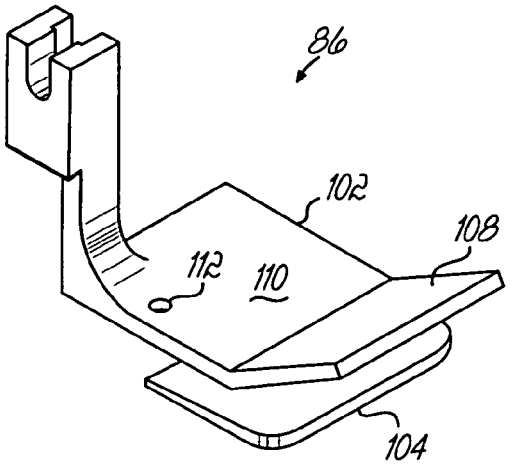
FIG. 7A is a perspective view of the presser foot used in accordance with the present invention.
Figure 7B:
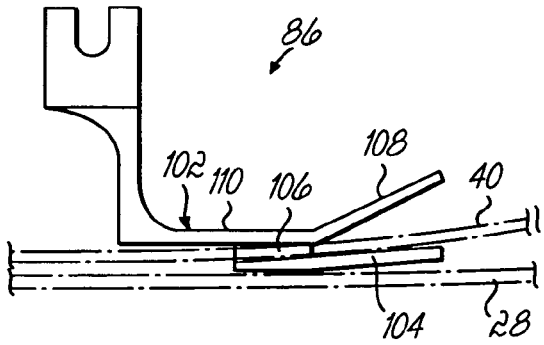
FIG. 7B is a side elevational view of the presser foot of FIG. 7A.

FIGS. 7A and 7B illustrate the presser foot 86 according to another aspect of the present invention. The presser foot 86 comprises an upper plate 102 joined to a lower plate 104 with a connector 106 shown in FIG. 7B. The upper plate 102 has a forward portion 108 inclined relative to a rearward portion 110 to provide easy access for the welt cord 40 between the upper and lower plates 102, 104. The rearward portion 110 of the upper plate 102 has a hole 112 therein which enables the reciprocating needle 88 to pass through the presser foot 86 to sew the welt cord 40 to the web of border material 28. As shown in FIG. 7B, the lower plate 104 is located in front of the hole 112 so it does not interfere with the operation of the needle 88.

As best illustrated in FIG. 6, the first sewing machine 51 has a wheel or feed dog 114 having teeth 116 to grip the material placed thereon and move it downstream. The web of border material 28 is pushed downwardly against the feed dog 114 by the presser foot 86 and moved downstream by rotation of the feed dog 114.

FIG. 8 illustrates the web of border material 28 being moved in the direction of arrow 118 by the feed dog 114 and puller 94. Once the welt cord 40 is secured to the web of border material 28 the puller wheels 96 located on opposite sides of the welt cord 40 move the combined welt cord 40 and web of border material 28 downstream in the direction of arrow 118. The rotational speed of the feed dog 114 and the puller wheels 96 are approximately the same so that the web of border material 28 is not bunched during the sewing of the welt cord 40 the web of border material 28. In one preferred embodiment, the stitch rate is 5 stiches per inch.

Figure 9:
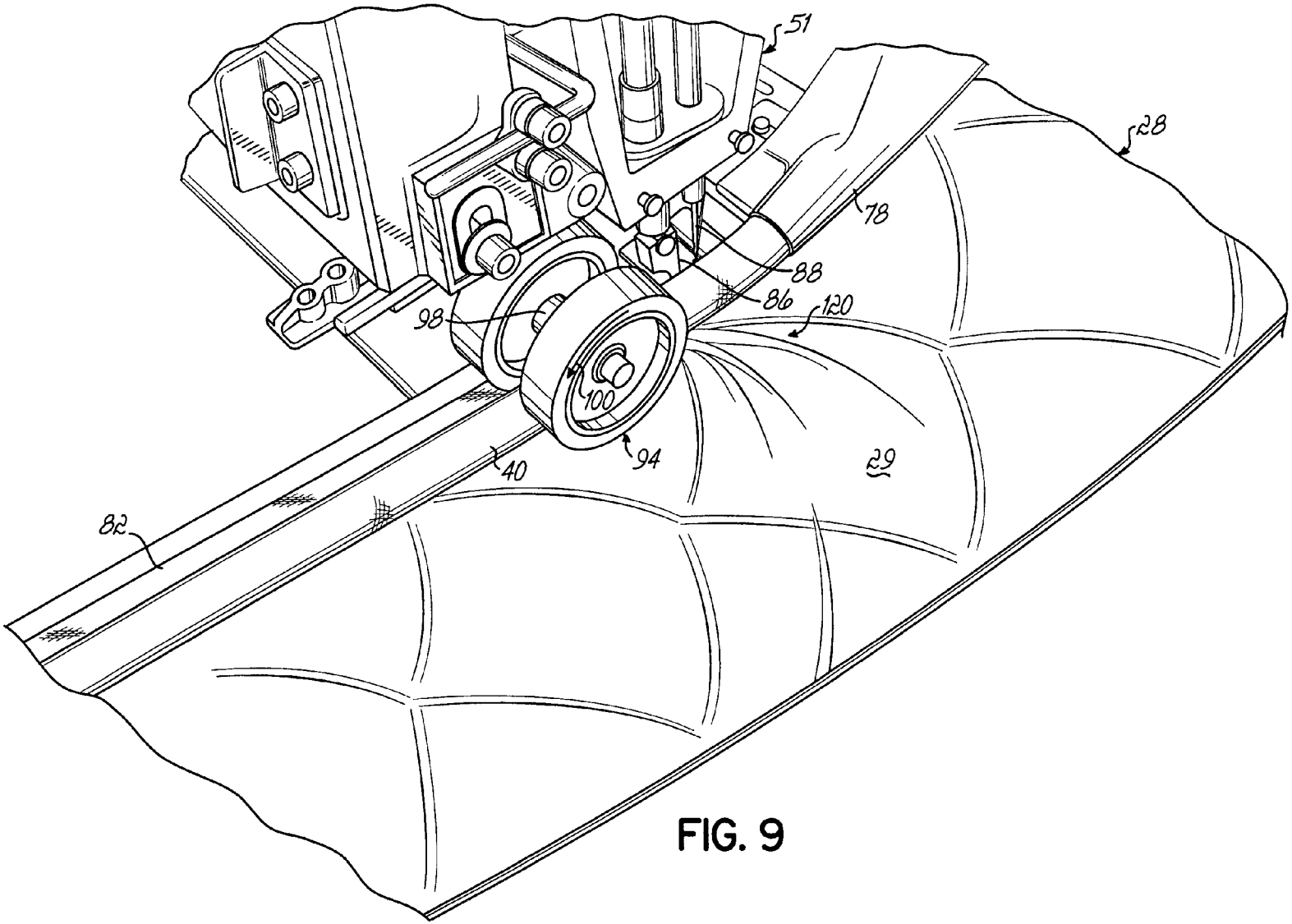
FIG. 9 is a perspective view of a portion of the sewing system of FIG. 4 illustrating the process of gathering the border material to create fullness in the border assembly.

Referring to FIG. 9, after the welt cord 40 has been joined to the web of border material 28 for a predetermined distance, the controller (not shown) slows the rotational speed of the puller wheels 96, thereby slowing the downstream flow of the border assembly 56 after the welt cord 40 has been joined to the web of border material 28. At select locations when the rotational speed of the puller wheels 96 has been slowed, the feed rate of the feed dog (not shown in FIG. 9) continues at the same rotational speed it originally had, i.e. it does not slow down when the rotational speed of the puller wheels 96 slows. Therefore, the web of border material 28 is gathered to impart fullness 120 in selected areas, as shown in FIG. 9. In a predetermined length of border material used to make a bedding product like the one shown in FIG. 1, four such areas of fullness are built into the border assembly to accommodate the four corners of the bedding product. This fullness enables the cover 26 of the bedding foundation 10 shown in FIG. 1 to fit around the bedding product such that the welt cord 40 extends upwardly from the upper surface of the product and is spaced inwardly a fixed distance from the perimeter of the product.

FIG. 10 illustrates a portion of the second sewing machine 68 which is used to sew the piece of non-skid decking 30 to the loop of border assembly 62 shown in FIG. 11. This second sewing machine 68 does not require any special presser foot like the one used in the first sewing machine 51. Therefore, any conventional sewing machine may be used for this step in the process.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art.

Therefore, the invention in its broadest aspects is not limited to the specific details shown and described. Consequently, departures may be made from the details described herein without departing from the spirit and scope of the claims which follow.

What is claimed is:

1. A method of manufacturing a cover for a bedding product, said method comprising:

forming a welt cord;

securing said welt cord to a side panel of said bedding product; and securing non-skid decking to the combined welt cord and side panel, the welt cord being sandwiched between the side panel and non-skid decking wherein said side panel is gathered at select locations prior to securing said welt cord to said side panel.

2. The method of claim 1 wherein said welt cord is made by sewing material around a filler cord.

3. The method of claim 1 wherein said welt cord and said side panel are sewn together.

4. The method of claim 1 wherein said non-skid decking is sewn to said combined side panel and welt cord.

5. A method of manufacturing a cover for a bedding product, said method comprising:

forming a welt cord;

sewing said welt cord to a web of border material to form a web of welted border;

cutting said web of welted border to a specified length;

securing opposite ends of said specified length of welted border together to form a loop; and sewing non-skid decking to the loop of welted border, the welt cord being sandwiched between the border material and non-skid decking wherein said web of border material is gathered at select locations prior to sewing said welt cord to said web of border material.

6. A method of manufacturing a cover for a bedding product, said method comprising:

forming a welt cord by wrapping material around a cord;

placing said welt cord above a web of border material;

sewing said welt cord to said web of border material;

cutting said welt cord and said web of border material to a predetermined length;

securing opposite ends of said border material to each other to form a loop; and sewing non-skid decking to the loop of border material, the welt cord being sandwiched between the border material and non-skid decking wherein said web of border material is gathered at select locations prior to sewing said welt cord to said web of border material.

7. The method of claim 6 wherein said welt cord is sewn to said web of border material at a first sewing machine and said non-skid decking is sewn to said loop of border material at a second sewing machine.

8. The method of claim 7 wherein said cutting occurs at said first sewing machine.

9. A method of manufacturing a cover for a bedding product, said method comprising:

forming a continuous welt cord;

placing said continuous welt cord above a web of border material;

feeding said continuous welt cord and said web of border material to a sewing machine, said sewing machine having a needle, a presser foot secured to a presser foot shaft, a variable speed puller and a controller to control the stitch rate of said sewing machine and the speed of rotation of said puller;

moving said web of border material with a feed dog of said sewing machine at a predetermined speed, said web of border material passing underneath a lower plate of said presser foot and said continuous welt cord passing between an upper plate and said lower plate of said presser foot;

sewing said continuous welt cord to said web of border material, said needle passing through said upper plate of said presser foot to create a border assembly;

pulling said border assembly with said puller.

10. The method of claim 9 further comprising cutting said border assembly to a predetermined length and securing opposite ends of said border assembly together.

11. The method of claim 10 further comprising securing non-skid decking to the border assembly, the welt cord being sandwiched between the border material and non-skid decking.

12. The method of claim 9 further comprising intermittently slowing the speed of rotation of said puller while maintaining said speed of said feed dog to gather said web of border material at select locations.

13. A method of manufacturing a cover for a bedding product, said method comprising:

forming a continuous welt cord;

placing said continuous welt cord above a web of border material;

moving said web of border material with a feed dog of a sewing machine along a supporting surface, said web of border material passing underneath a lower plate of a presser foot secured to a presser foot shaft of said sewing machine and said continuous welt cord passing between an upper plate and said lower plate of said presser foot;

sewing said continuous welt cord to said web of border material with a needle passing through said upper plate of said presser foot to create a border assembly;

pulling said border assembly with a puller located behind said presser foot;

intermittently slowing the speed of rotation of said puller while maintaining said speed of said feed dog of said sewing machine to gather said web of border material at select locations;

cutting said border assembly to a predetermined length.

14. The method of claim 13 further comprising securing non-skid decking to the border assembly, the welt cord being sandwiched between the side panel and non-skid decking.

15. A method of manufacturing a bedding foundation, said method comprising:

securing a spring assembly to a base;

manufacturing a cover for the bedding foundation by constructing a welt cord;

securing a side panel to the welt cord;

securing non-skid decking to the combined welt cord and side panel, the welt cord being sandwiched between the side panel and non-skid decking;

separating the side panel and non-skid decking so as to expose the welt cord; and wrapping the cover around the spring assembly and base such that the welt cord extends upwardly and is spaced inwardly from the perimeter of the bedding foundation; and securing the cover to the base.

16. The method of claim 15 wherein said welt cord is made by sewing border material around a filler cord.

17. The method of claim 15 wherein said side panel is sewn to said welt cord.

18. The method of claim 15 wherein said non-skid decking is sewn to said combined welt cord and side panel.

19. The method of claim 15 wherein said side panel is gathered at select locations prior to securing said welt cord to said side panel.

* * * * *